US010859271B2

(12) United States Patent
Rimmer et al.

(10) Patent No.: US 10,859,271 B2
(45) Date of Patent: Dec. 8, 2020

(54) COMBUSTION CHAMBER

(71) Applicant: ROLLS-ROYCE PLC, London (GB)

(72) Inventors: John E Rimmer, Loughborough (GB); Damian Martin, Derby (GB); David P Wilson, Derby (GB)

(73) Assignee: ROLLS-ROYCE plc, London (GB)

( * ) Notice: Subject to any disclaimer, the term of this patent is extended or adjusted under 35 U.S.C. 154(b) by 140 days.

(21) Appl. No.: 16/118,966

(22) Filed: Aug. 31, 2018

(65) Prior Publication Data

US 2019/0093892 A1 Mar. 28, 2019

(30) Foreign Application Priority Data

Sep. 22, 2017 (GB) ..... 1715366.9

(51) Int. Cl.

| | |
|---|---|
| ***F23R 3/28*** | (2006.01) |
| ***F23R 3/50*** | (2006.01) |
| ***F23R 3/10*** | (2006.01) |
| ***F23R 3/00*** | (2006.01) |

(52) U.S. Cl.

CPC ..... *F23R 3/283* (2013.01); *F23R 3/002* (2013.01); *F23R 3/10* (2013.01); *F23R 3/50* (2013.01); *F23R 2900/00005* (2013.01); *F23R 2900/03042* (2013.01)

(58) Field of Classification Search

CPC .... F23R 3/002; F23R 3/04; F23R 3/06; F23R 3/283; F23R 2900/03041; F23R 2900/03042; F23R 2900/03043; F23R 2900/03044; F23R 2900/03045

See application file for complete search history.

(56) References Cited

U.S. PATENT DOCUMENTS

| | | | |
|---|---|---|---|
| 4,241,586 | A | 12/1980 | Caruel et al. |
| 4,380,905 | A | 4/1983 | Smart et al. |
| 5,253,471 | A | 10/1993 | Richardson |
| 5,259,182 | A | 11/1993 | Iwai et al. |

(Continued)

OTHER PUBLICATIONS

Jan. 15, 2019 Search Report issued in European Patent Application No. 18191685.

(Continued)

*Primary Examiner* — Scott J Walthour
*Assistant Examiner* — David P. Olynick
(74) *Attorney, Agent, or Firm* — Oliff PLC

(57) ABSTRACT

A combustion chamber comprises an upstream end wall structure and inner and outer annular wall structures. The upstream end wall structure comprises an upstream wall and a plurality of circumferentially arranged heat shields secured to the upstream wall. The upstream wall has a plurality of circumferentially spaced fuel injector apertures. Each heat shield has radially outer and radially inner ends and a fuel injector aperture aligned with a corresponding fuel injector aperture in the upstream wall. The radially outer and inner ends of each heat shield have outer and inner rails spacing the heat shield from the upstream wall. The radially outer and inner ends of each heat shield have first and second pluralities of circumferentially spaced apertures extending there-through and through the associated outer and inner rails to direct coolant over the surface of the outer and inner annular wall structures to form respective films of coolant.

20 Claims, 4 Drawing Sheets

(56) References Cited

U.S. PATENT DOCUMENTS

| | | | | |
|---|---|---|---|---|
| 5,271,219 | A | 12/1993 | Richardson | |
| 5,279,127 | A | 1/1994 | Napoli | |
| 5,396,759 | A | 3/1995 | Richardson | |
| 5,479,774 | A | 1/1996 | Burnell et al. | |
| 5,490,389 | A | 2/1996 | Harrison et al. | |
| 5,509,270 | A | 4/1996 | Pearce et al. | |
| 5,894,732 | A | 4/1999 | Kwan | |
| 5,934,066 | A | 8/1999 | Schmid et al. | |
| 5,956,955 | A | 9/1999 | Schmid | |
| 6,286,317 | B1 | 9/2001 | Burrus et al. | |
| 6,679,063 | B2 | 1/2004 | Ebel | |
| 6,751,961 | B2 * | 6/2004 | Pacheco-Tougas | F23R 3/002 60/752 |
| 7,124,588 | B2 | 10/2006 | Gerendas et al. | |
| 8,938,970 | B2 | 1/2015 | Gerendas et al. | |
| 9,534,786 | B2 | 1/2017 | Sreekanth et al. | |
| 2008/0010992 | A1 * | 1/2008 | Patterson | F23R 3/06 60/772 |
| 2008/0115506 | A1 | 5/2008 | Patel et al. | |
| 2011/0005233 | A1 | 1/2011 | Sadig et al. | |
| 2012/0272661 | A1 | 11/2012 | Milburn | |
| 2013/0042627 | A1 | 2/2013 | Gerendas et al. | |
| 2015/0059349 | A1 | 3/2015 | Patel et al. | |
| 2015/0135720 | A1 | 5/2015 | Papple et al. | |
| 2015/0260404 | A1 | 9/2015 | Sullivan | |
| 2016/0265772 | A1 * | 9/2016 | Eastwood | F23R 3/002 |
| 2016/0273772 | A1 * | 9/2016 | Cunha | F23R 3/005 |
| 2016/0298841 | A1 | 10/2016 | Papple et al. | |
| 2017/0191664 | A1 | 7/2017 | Bennett | |

OTHER PUBLICATIONS

Mar. 7, 2018 Search Report issued in British Patent Application No. 1715366.9.

* cited by examiner

COMBUSTION CHAMBER

The present disclosure relates to a combustion chamber and in particular to a gas turbine engine combustion chamber.

A combustion chamber comprises an upstream end wall structure, an inner annular wall structure secured to the upstream end wall structure and an outer annular wall structure secured to the upstream end wall structure and spaced radially from the inner annular wall structure. The upstream wall structure comprises an upstream wall and a plurality of heat shields secured to and spaced axially from the upstream end wall. The upstream end wall has a plurality of circumferentially spaced fuel injector apertures. The heat shields are arranged circumferentially around the combustion chamber and each heat shield has a radially outer end, a radially inner end and a fuel injector aperture aligned with a corresponding one of the fuel injector apertures in the upstream end wall. The radially outer end of each heat shield has a rail spacing the heat shield from the upstream end wall and the radially inner end of each heat shield has a rail spacing the heat shield from the upstream end wall. The radially outer end of each heat shield also has a curved lip which extends radially outwardly towards the outer annular wall structure and the radially inner end of each heat shield also has a curved lip which extends radially inwardly towards the inner annular wall structure. The rails define a chamber between the upstream wall and the heat shields and the upstream wall is provided with a plurality of apertures to supply coolant into the chamber. Each heat shield has pedestals on the surface facing the upstream wall to cool the heat shield and each heat shield has a plurality of apertures arranged circumferentially around the fuel injector aperture and extending there-through to supply coolant from the chamber radially outwardly with respect to the fuel injector aperture to provide effusion cooling of the surface facing away from the upstream wall. The upstream wall has a plurality of apertures to direct coolant onto the curved lips at the radially inner and radially outer ends of the heat shields to provide impingement cooling of the lips and to form a film of coolant on the inner and outer annular walls.

However, the curved lips at the radially inner and radially outer ends of the heat shields suffer from overheating and oxidation because they are only cooled by impingement cooling of their surfaces facing the upstream wall. The coolant supplied through the apertures in the heat shields is not used to reduce emissions of the combustion chamber. The film of coolant on the inner and outer annular wall structures is uniform circumferentially around the combustion chamber using more coolant than is required. The heat shields suffer from overheating and oxidation adjacent to the fuel injector apertures when the associated fuel injector seals have suffered overheating and oxidation.

The present disclosure seeks to reduce or overcome the above mentioned problems.

According to a first aspect of the present disclosure there is provided a combustion chamber comprising an upstream end wall structure, an inner annular wall structure, an outer annular wall structure spaced radially from the inner annular wall structure, the upstream end wall structure comprising an upstream wall and a plurality of heat shields secured to and spaced axially from the upstream wall, the inner annular wall structure being secured to the upstream wall, the outer annular wall structure being secured to the upstream wall, the upstream wall having a plurality of circumferentially spaced fuel injector apertures, the heat shields being arranged circumferentially around the combustion chamber, each heat shield having a radially outer end, a radially inner end and a fuel injector aperture aligned with a corresponding one of the fuel injector apertures in the upstream end wall, the radially outer end of each heat shield having an outer rail spacing the heat shield from the upstream end wall, the radially inner end of each heat shield having an inner rail spacing the heat shield from the upstream end wall, a remote end of the outer rail of each heat shield having a surface abutting the upstream wall, a remote end of the inner rail of each heat shield having a surface abutting the upstream wall, the radially outer end of each heat shield having a first plurality of circumferentially spaced apertures extending there-through and through the associated outer rail to direct coolant over the surface of the outer annular wall structure to form a film of coolant, the first plurality of circumferentially spaced apertures of each heat shield extending through the associated outer rail from respective inlets in the surface abutting the upstream wall to respective outlets in a surface of the heat shield facing away from the upstream wall, the radially inner end of each heat shield having a second plurality of circumferentially spaced apertures extending there-through and through the associated inner rail to direct coolant over the surface of the inner annular wall structure to form a film of coolant, the second plurality of circumferentially spaced apertures of each heat shield extending through the associated inner rail from respective inlets in the surface abutting the upstream wall to respective outlets in the surface of the heat shield facing away from the upstream wall.

A third plurality of circumferentially spaced apertures may extend through the heat shields to direct coolant towards the centre of the combustion chamber and the first plurality of apertures being positioned radially outwardly of the third plurality of apertures, a fourth plurality of circumferentially spaced apertures may extend through the heat shields to direct coolant towards the centre of the combustion chamber and the second plurality of apertures being positioned radially inwardly of the fourth plurality of apertures.

The third plurality of circumferentially spaced apertures may extend through the associated outer rail to direct coolant towards the centre of the combustion chamber and the fourth plurality of circumferentially spaced apertures may extend through the associated inner rail to direct coolant towards the centre of the combustion chamber.

The third plurality of circumferentially spaced apertures of each heat shield may extend through the associated outer rail from respective inlets in the surface abutting the upstream wall to respective outlets in the surface of the heat shield facing away from the upstream wall. The fourth plurality of circumferentially spaced apertures of each heat shield may extend through the associated inner rail from respective inlets in the surface abutting the upstream wall to respective outlets in the surface of the heat shield facing away from the upstream wall.

The cross-sectional area of the first plurality of apertures may vary circumferentially around the combustion chamber and the cross sectional area of the second plurality of apertures may vary circumferentially around the combustion chamber.

Each heat shield may have a planar surface facing away from the upstream wall.

Each heat shield may have a flange extending radially outwardly towards the outer annular wall structure from the outer rail at the radially outer end of the heat shield and the flange extending parallel to the planar surface facing away from the upstream wall. The flange may abut the outer annular wall structure.

Each heat shield may have a flange extending radially inwardly towards the inner annular wall structure from the inner rail at the radially inner end of the heat shield, the flange extending parallel to the planar surface facing away from the upstream wall. The flange may abut the inner annular wall structure.

The diameter of each of the apertures of the first plurality of apertures may be greater than or equal to 0.4 mm and less than or equal to 6 mm and the distance between adjacent apertures of the first plurality of apertures being greater than or equal to half the diameter of the apertures and less than or equal to four times the diameter of the apertures.

The apertures of the first plurality of apertures may be arranged to direct the coolant circumferentially at angle of greater than or equal to −60° to less than or equal to +60°, where the positive direction is the direction of flow from the fuel injector.

The apertures of the first plurality of apertures may be arranged to direct the coolant at an angle of less than or equal to 10° towards the centre of the combustion chamber or equal to or less than 60° towards the outer annular wall structure.

The axes of the first set of apertures may be arranged parallel to the surface of the outer annular wall structure.

The axes of the apertures of the first plurality of apertures may be spaced from the surface of the outer annular wall structure by a distance equal to or greater than half the diameter of the apertures and less than or equal to five times the diameter of the apertures.

The diameter of each of the apertures of the third plurality of apertures may be greater than or equal to 0.5 mm and less than or equal to 3.5 mm and the distance between adjacent apertures of the third plurality of apertures being greater than or equal to one diameter of the apertures and less than or equal to five times the diameter of the apertures.

The apertures of the third plurality of apertures may be arranged to direct the coolant circumferentially at angle of greater than or equal to −10° to less than or equal to +60°, where the positive direction is the direction of flow from the fuel injector.

The apertures of the third plurality of apertures may be arranged to direct the coolant at an angle $\alpha$ of greater than or equal to 0° to less than or equal 70° towards the centre of the combustion chamber.

The diameter of each of the apertures of the second plurality of apertures may be greater than or equal to 0.4 mm and less than or equal to 6 mm and the distance between adjacent apertures of the second plurality of apertures being greater than or equal to half the diameter of the apertures and less than or equal to four times the diameter of the apertures.

The apertures of the second plurality of apertures may be arranged to direct the coolant circumferentially at angle of greater than or equal to −60° to less than or equal to +60°, where the positive direction is the direction of flow from the fuel injector.

The apertures of the second plurality of apertures may be arranged to direct the coolant at an angle of less than or equal to 10° towards the centre of the combustion chamber or equal to or less than 60° towards the inner annular wall structure.

The axes of the second set of apertures may be arranged parallel to the surface of the inner annular wall structure.

The axes of the apertures of the second plurality of apertures may be spaced from the surface of the inner annular wall structure by a distance equal to or greater than half the diameter of the apertures and less than or equal to five times the diameter of the apertures.

The diameter of each of the apertures of the fourth plurality of apertures may be greater than or equal to 0.5 mm and less than or equal to 3.5 mm and the distance between adjacent apertures of the fourth plurality of apertures being greater than or equal to one diameter of the apertures and less than or equal to five times the diameter of the apertures.

The apertures of the fourth plurality of apertures may be arranged to direct the coolant circumferentially at angle of greater than or equal to −10° to less than or equal to +60°, where the positive direction is the direction of flow from the fuel injector.

The apertures of the fourth plurality of apertures may be arranged to direct the coolant at an angle $\alpha$ of greater than or equal to 0° to less than or equal 70° towards the centre of the combustion chamber.

The inner annular wall structure may comprise a first annular wall secured to the upstream wall and at least one row of circumferentially arranged tiles, the at least one row of tiles being secured to and spaced radially outwardly from the first annular wall.

The inner diameter of the inner rail of each heat shield may be arranged at a diameter less than the inner diameter of the upstream ends of the tiles of the row of tiles secured to the first annular wall.

The outer annular wall structure may comprise a second annular wall secured to the upstream wall and at least one row of circumferentially arranged tiles, the at least one row of tiles being secured to and spaced radially inwardly from the second annular wall.

The outer diameter of the outer rail of each heat shield may be arranged at a diameter greater than the inner diameter of the upstream ends of the tiles of the row of tiles secured to the second annular wall.

The apertures of the first plurality of apertures may be circular or elongated in a circumferential direction and the apertures of the third plurality of apertures being circular or elongated in a radial direction.

The apertures of the second plurality of apertures may be circular or elongated in a circumferential direction and the apertures of the fourth plurality of apertures being circular or elongated in a radial direction.

The total flow through the third and fourth plurality of apertures may be arranged to ensure that there is sufficient coolant, air, to penetrate into the primary combustion zone to minimise smoke production and to minimise disruption of the flow fields produced by the fuel injectors. The total flow through the third and fourth plurality of apertures may be equal to or greater than 0.25% of the total combustor air mass flow and equal to or less than 3% of the total combustor air mass flow.

The total flow through the first and second plurality of apertures may be arranged to ensure that there is sufficient coolant, air, to form a cooling film of coolant, air, on the surfaces of the outer annular wall structure and inner annular structure respectively. The total flow through the first and third plurality of apertures may be equal to or greater than 0.5% of the total combustor air mass flow and equal to or less than 5% of the total combustor air mass flow.

The skilled person will appreciate that except where mutually exclusive, a feature described in relation to any one of the above aspects of the invention may be applied mutatis mutandis to any other aspect of the invention.

Embodiments of the invention will now be described by way of example only, with reference to the Figures, in which.

Figure 1:
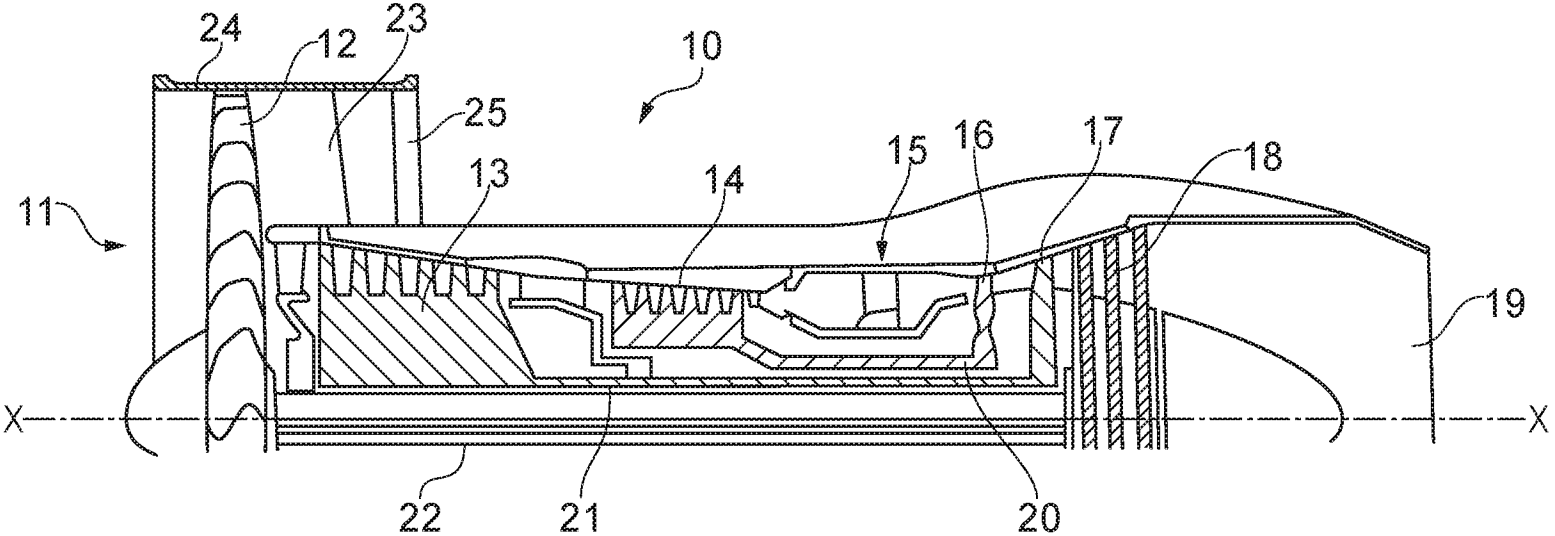
FIG. 1 is a sectional side view of a gas turbine engine having a combustion chamber according to the present disclosure.

With reference to FIG. 1, a gas turbine engine is generally indicated at 10, having a principal and rotational axis X-X. The engine 10 comprises, in axial flow series, an air intake 11, a propulsive fan 12, an intermediate pressure compressor 13, a high-pressure compressor 14, combustion equipment 15, a high-pressure turbine 16, an intermediate pressure turbine 17, a low-pressure turbine 18 and an exhaust nozzle 19. A fan nacelle 24 generally surrounds the fan 12 and defines the intake 11 and a fan duct 23. The fan nacelle 24 is secured to the core engine by fan outlet guide vanes 25.

The gas turbine engine 10 works in the conventional manner so that air entering the intake 11 is compressed by the fan 12 to produce two air flows: a first air flow into the intermediate pressure compressor 13 and a second air flow which passes through the bypass duct 23 to provide propulsive thrust. The intermediate pressure compressor 13 compresses the air flow directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high 16, intermediate 17 and low 18 pressure turbines drive respectively the high pressure compressor 14, the intermediate pressure compressor 13 and the fan 12, each by suitable interconnecting shaft 20, 21 and 22 respectively.

Figure 2:
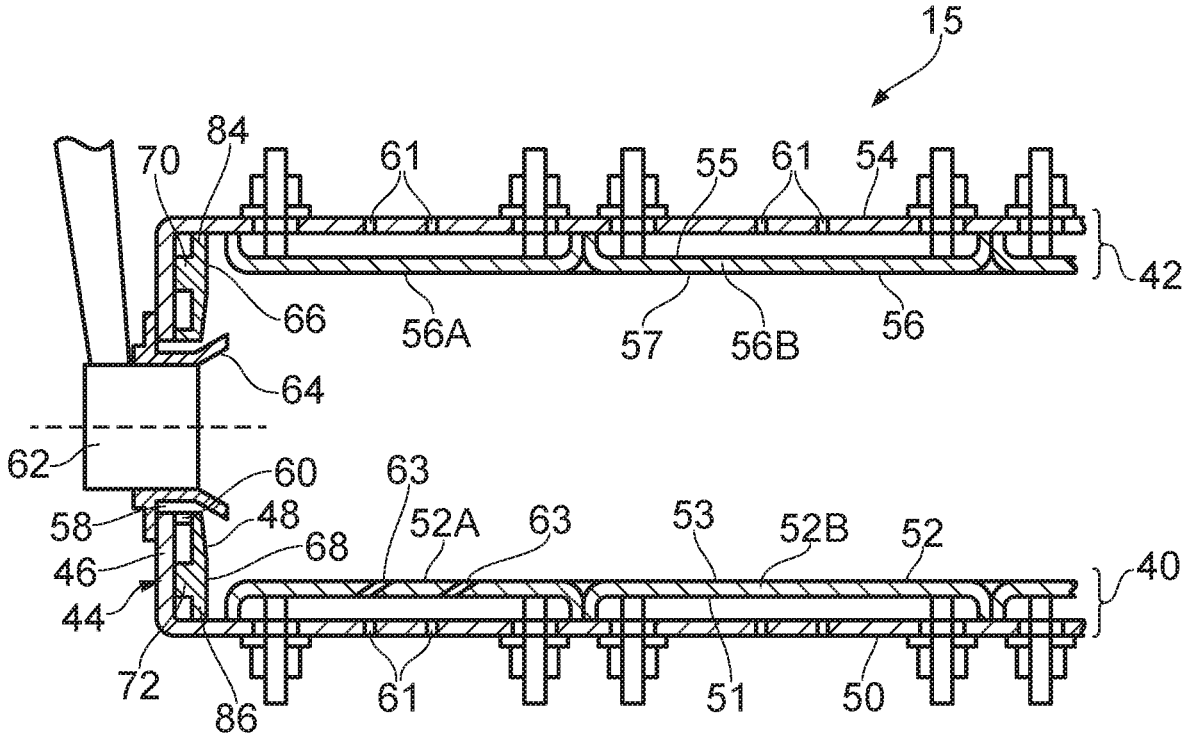
FIG. 2 is an enlarged cross-sectional view through a combustion chamber according to the present disclosure.

The combustion chamber 15, as shown more clearly in FIG. 2, is an annular combustion chamber and comprises an upstream end wall structure 44, an inner annular wall structure 40 and an outer annular wall structure 42 spaced radially, radially outwardly, from the inner annular wall structure 40. The upstream end wall structure 44 comprises an upstream wall 46 and a plurality of heat shields 48 secured to and spaced axially from the upstream wall 46 to define at least one chamber 47 there-between. The heat shields 48 are arranged circumferentially around the combustion chamber 15. The inner annular wall structure 40 is secured to the upstream wall 46 and the outer annular wall structure 42 is secured to the upstream wall 46. The inner annular wall structure 40 comprises a first annular wall 50 and a second annular wall 52 and the outer annular wall structure 42 comprises a third annular wall 54 and a fourth annular wall 56. The second annular wall 52 is spaced radially from and is arranged radially around the first annular wall 50 and the first annular wall 50 supports the second annular wall 52. The fourth annular wall 56 is spaced radially from and is arranged radially within the third annular wall 54 and the third annular wall 54 supports the fourth annular wall 56. The upstream end of the first annular wall 50 is secured to the upstream wall 46 of the upstream end wall structure 44 and the upstream end of the third annular wall 54 is secured to the upstream wall 46 of the upstream end wall structure 44. The upstream wall 46 has a plurality of circumferentially spaced fuel injector apertures 58 and each heat shield 48 has a fuel injector aperture 60 aligned with a corresponding one of the fuel injector apertures 58 in the upstream wall 46. The combustion chamber 15 also comprises a plurality of fuel injectors 62 and a plurality of seals 64. Each fuel injector 62 is arranged in a corresponding one of the fuel injector apertures 58 in the upstream wall 46 and in a fuel injector aperture 60 in a corresponding one of the heat shields 48. Each seal 64 is arranged in a corresponding one of the fuel injector apertures 58 in the upstream wall 46 and in a fuel injector aperture 60 in a corresponding one of the heat shields 48 and each seal 64 is arranged around, e.g. surrounds, the corresponding one of the fuel injectors 62. The fuel injectors 62 are arranged to supply fuel into the annular combustion chamber 15 during operation of the gas turbine engine 10. The second annular wall 52 comprises a plurality of rows of combustion chamber tiles 52A and 52B and the fourth annular wall 56 comprises a plurality of rows of combustion chamber tiles 56A and 56B. Each row of tiles 52A, 52B, 56A and 56B comprises a plurality of circumferentially arranged tiles. The combustion chamber tiles 52A and 52B are secured onto the first annular wall 50 by threaded studs, washers and nuts and the combustion chamber tiles 56A and 56B are secured onto the third annular wall 54 by threaded studs, washers and nuts.

The first annular wall 50 is provided with a plurality of impingement cooling apertures 61 extending perpendicularly there-through to direct coolant, air, onto the surfaces 51 of the tiles 52A and 52B facing the first annular wall 50 and the tiles 52A and 52B are provided with angled effusion cooling apertures 63 to provide a film of coolant on the surfaces 53 of the tiles facing away from the first annular wall 50. Similarly, the third annular wall 54 is provided with a plurality of impingement cooling apertures 61 extending perpendicularly there-through to direct coolant, air, onto the surfaces 55 of the tiles 56A and 56B facing the third annular wall 54 and the tiles 56A and 56B are provided with angled effusion cooling apertures 63 to provide a film of coolant on the surfaces 57 of the tiles facing away from the third annular wall 54.

Figure 3:
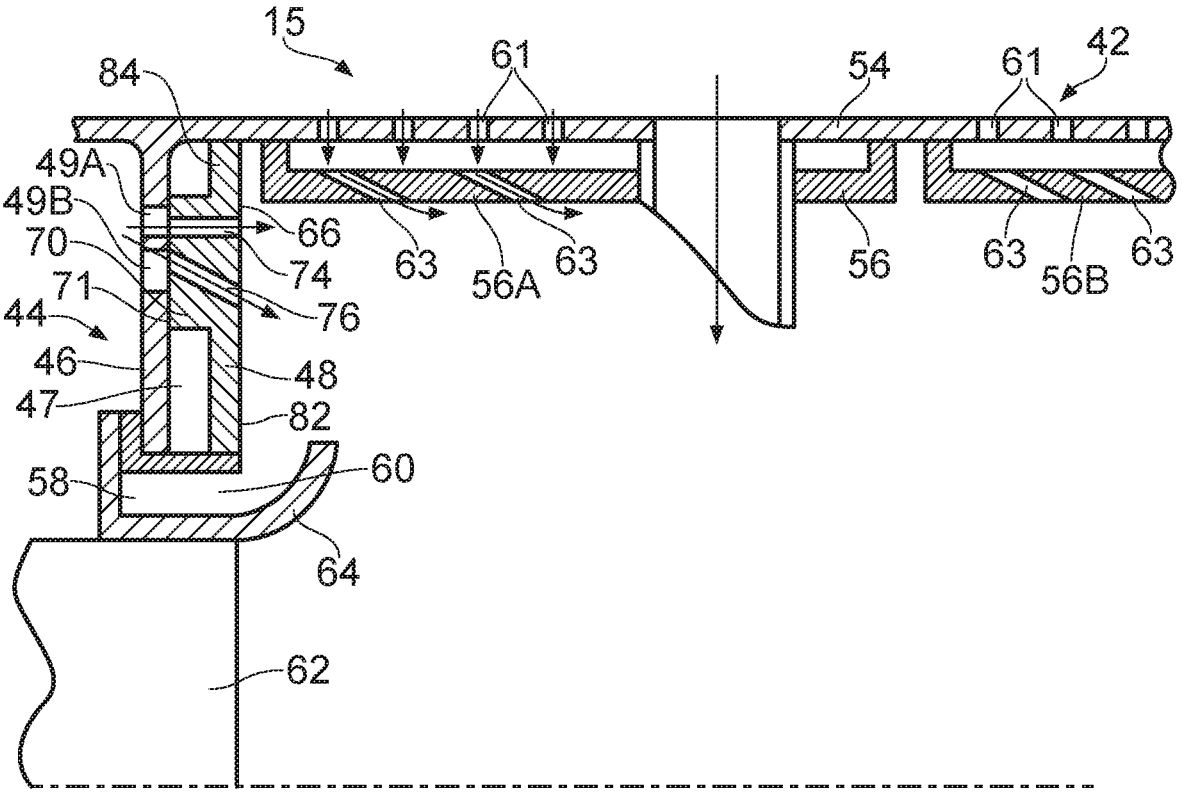
FIG. 3 is a further enlarged cross-sectional view of part of the upstream end wall structure and the outer annular wall structure of the combustion chamber shown in FIG. 2.
Figure 4:
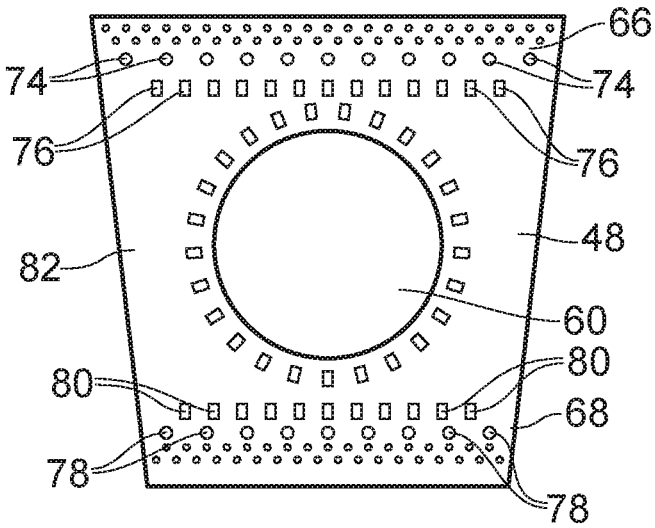
FIG. 4 is a plan view of a heat shield shown in FIG. 3.

Each heat shield 48 has a radially outer end 66 and a radially inner end 68 as shown more clearly in FIGS. 2, 3 and 4. The radially outer end 66 of each heat shield 48 has an outer rail 70 spacing the heat shield 48 from the upstream wall 46 and the radially inner end 68 of each heat shield 48 has an inner rail 72 spacing the heat shield 48 from the upstream wall 46. The outer rail 70 of each heat shield 48 extends in an axially upstream direction and abuts the upstream wall 46 and similarly the inner rail 72 of each heat shield 48 extends in an axially upstream direction and abuts the upstream wall 46. A remote end, the upstream end, of the outer rail 70 of each heat shield 48 has a surface 71 which abuts the upstream wall 46. Similarly, a remote end, the upstream end, of the inner rail 72 of each heat shield 48 has a surface which abuts the upstream wall 46. The outer rail 70 of each heat shield 48 extends throughout the full, circumferential, length of the heat shield 48. Similarly, the inner rail 72 of each heat shield 48 extends throughout the full, circumferential, length of the heat shield 48. The outer rail 70 of each heat shield 48 is aligned with the outer rails 70 of circumferentially adjacent heat shields 48 to form a ring. Similarly, the inner rail 72 of each heat shield 48 is aligned with the inner rails 72 of circumferentially adjacent heat shields 48 to form a ring.

The radially outer end 66 of each heat shield 48 has a first plurality of circumferentially spaced apertures 74 extending there-through and through the associated outer rail 70 to direct coolant over the surface of the outer annular wall structure 42 to form a film of coolant. The radially outer end 66 of each heat shield 48 has a third plurality of circumferentially spaced apertures 76 extending there-through and through the associated outer rail 70 to direct coolant radially inwardly towards the centre of the combustion chamber 15. The first plurality of apertures 74 are positioned radially outwardly of the third plurality of apertures 76. Similarly, the radially inner end 68 of each heat shield 48 has a second plurality of circumferentially spaced apertures 78 extending there-through and through the associated inner rail 72 to direct coolant over the surface of the inner annular wall structure 40 to form a film of coolant. The radially inner end 68 of each heat shield 48 has a fourth plurality of circumferentially spaced apertures 80 extending there-through and through the associated inner rail 72 to direct coolant radially outwardly towards the centre of the combustion chamber 15 and the second plurality of apertures 78 are positioned radially inwardly of the fourth plurality of apertures 80. The first plurality of circumferentially spaced apertures 74 of each heat shield 48 extend through the associated outer rail 70 from respective inlets in the surface 71 which abuts the upstream wall 46 to respective outlets in a surface 82 of the heat shield 48 facing away from the upstream wall 46. The third plurality of circumferentially spaced apertures 76 of each heat shield 48 also extend through the associated outer rail 70 from respective inlets in the surface 71 which abuts the upstream wall 46 to respective outlets in the surface 82 of the heat shield 48 facing away from the upstream wall 46. The second plurality of circumferentially spaced apertures 78 of each heat shield 48 extend through the associated inner rail 72 from respective inlets in the surface which abuts the upstream wall 46 to respective outlets in the surface 82 of the heat shield 48 facing away from the upstream wall 46. The fourth plurality of circumferentially spaced apertures 80 of each heat shield 48 also extend through the associated inner rail 72 from respective inlets in the surface which abuts the upstream wall 46 to respective outlets in the surface 82 of the heat shield 48 facing away from the upstream wall 46.

The upstream wall 46 is provided with a plurality of apertures 49A each one of which is aligned with a corresponding one of the first plurality of apertures 74 and a plurality of apertures 49B each one of which is aligned with a corresponding one of the third plurality of apertures 76. Similarly, the upstream wall 46 is provided with a plurality of apertures (not shown) each one of which is aligned with a corresponding one of the second plurality of apertures 78 and a plurality of apertures each one of which is aligned with a corresponding one of the fourth plurality of apertures 80.

The upstream wall 46 is provided with impingement cooling apertures to direct coolant, air, into the at least one chamber 47 and onto the surfaces of the heat shields 48 facing the upstream wall 46. The heat shields 48 may have pedestals extending from their surfaces facing the upstream wall 46 to cool the heat shields 48, or may have effusion cooling apertures extending there-through to provide a film of coolant on the surfaces 82 of the heat shields 48 facing away from the upstream wall 46 or may have pedestals extending from their surfaces facing the upstream wall 46 to cool the heat shields 48 and have effusion cooling apertures extending there-through to provide a film of coolant on the surfaces 82 of the heat shields 48 facing away from the upstream wall 46.

The cross-sectional area of the first plurality of apertures 74 may vary circumferentially around the combustion chamber 15 and the spacing L between the apertures 74 may be constant circumferentially around the combustion chamber 15 and the cross sectional area of the second plurality of apertures 78 may vary circumferentially around the combustion chamber 15 and the spacing L between the apertures 78 may be constant circumferentially around the combustion chamber 15. Alternatively, the cross-sectional area of the first plurality of apertures 74 may be constant circumferentially around the combustion chamber 15 but the spacing L between the apertures 74 may vary circumferentially around the combustion chamber 15 and the cross-sectional area of the second plurality of apertures 78 may be constant circumferentially around the combustion chamber 15 but the spacing L between the apertures 78 may vary circumferentially around the combustion chamber 15.

Each heat shield 48 also has a planar surface 82 facing away from the upstream wall 46. Each heat shield 48 has a flange 84 extending radially outwardly towards the third annular wall 54 from the outer rail 70 at the radially outer end 66 of the heat shield 48 and the flange 84 extends parallel to the planar surface 82 facing away from the upstream wall 46. The flange 84 may abut the third annular wall 54 or alternatively the flange 84 may be closely spaced from the third annular wall 54 such that the flange 84 forms a seal with the third annular wall 54. Each heat shield 48 also has a flange 86 extending radially inwardly towards the first annular wall 50 from the inner rail 72 at the radially inner end 68 of the heat shield 48 and the flange 86 extends parallel to the planar surface 82 facing away from the upstream wall 46. The flange 86 may abut the first annular wall 50 or alternatively be closely spaced from the first annular wall 50 such that the flange 86 forms a seal with the first annular wall 50.

It is to be noted that the upstream end of each of the tiles 52A in the second annular wall 52 has a radially inwardly extending rail 59A which abuts the first annular wall 50 and that the upstream end of each of the tiles 56A in the fourth annular wall 56 has a radially outwardly extending rail 59B which abuts the third annular wall 54. It is further to be noted that the upstream ends of the tiles 52A are spaced axially downstream from the flanges 86 extending radially inwardly from the inner rails 72 of the heat shields 48 and that the upstream ends of the tiles 56A are spaced axially downstream from the flanges 84 extending radially outwardly from the outer rails 70 of the heat shields 48.

Figure 6:
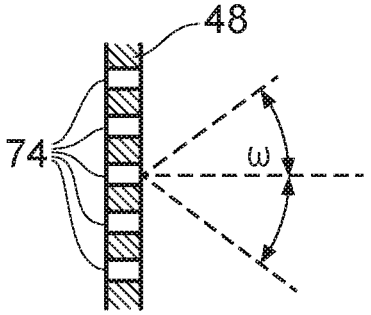
FIG. 6 is a cross-sectional view in the direction of arrows A-A in FIG. 5.
Figure 5:
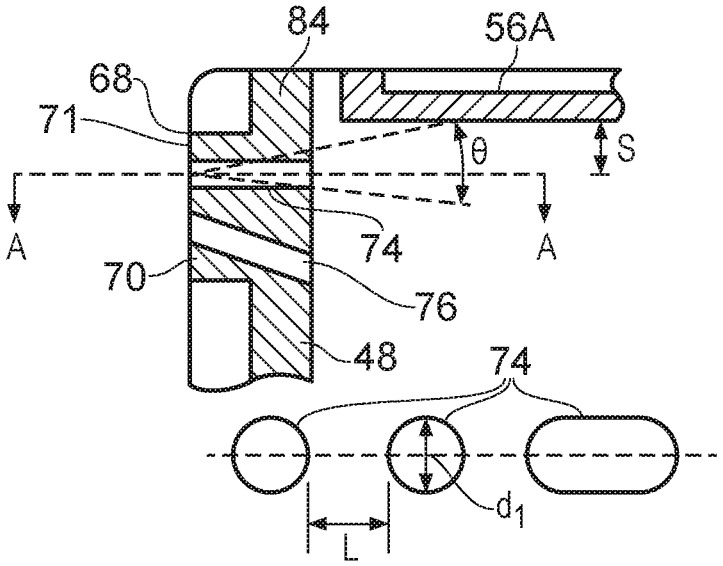
FIG. 5 is an enlarged cross-sectional view of part of the upstream end wall structure showing details of a first plurality of apertures in the heat shield shown in FIG. 3.

Referring to FIGS. 5 and 6, the diameter d1 of each of the apertures of the first plurality of apertures 74 is greater than or equal to 0.4 mm and less than or equal to 6 mm. The distance L between adjacent apertures of the first plurality of apertures 74 is greater than or equal to half the diameter d1 of the apertures and is less than or equal to four times the diameter d1 of the apertures. The apertures of the first plurality of apertures 74 are arranged to direct the coolant circumferentially at angle $\omega$ of greater than or equal to $-60°$ to less than or equal to $+60°$, where the positive direction is the direction of flow from the fuel injector 62. The apertures of the first plurality of apertures 74 are arranged to direct the coolant at an angle θ of less than or equal to 10° towards the centre of the combustion chamber 15 or equal to or less than 60° towards the outer annular wall structure 42. In one particular arrangement the axes of the first plurality of apertures 74 are arranged parallel to the surface of the outer annular wall structure 42. In another arrangement the axes of the first plurality of apertures 74 are angled circumferentially to form a swirling flow of coolant on the surfaces of the tiles 56A which increases convective cooling of the tiles 56A. The axes of the apertures of the first plurality of apertures 74 are spaced from the surface of the outer annular wall structure 42 by a distance S equal to or greater than half the diameter d1 of the apertures and less than or equal to five times the diameter d1 of the apertures.

Figure 7:
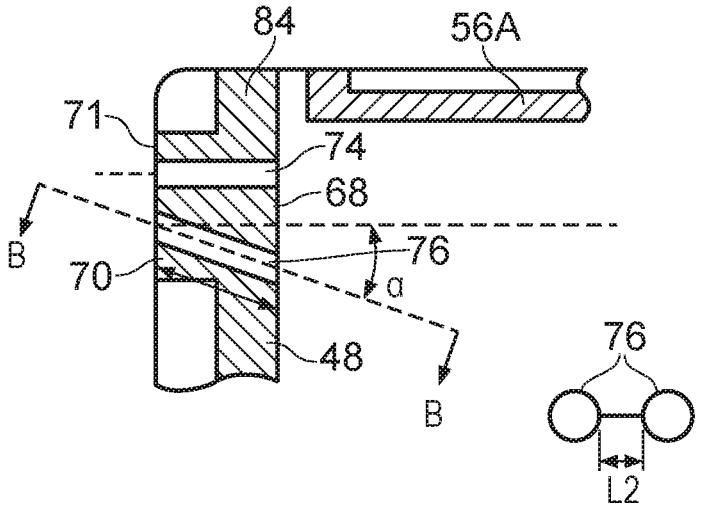
FIG. 7 is an enlarged cross-sectional view of part of the upstream end wall structure showing details of a third plurality of apertures in the heat shield shown in FIG. 3.
Figure 8:
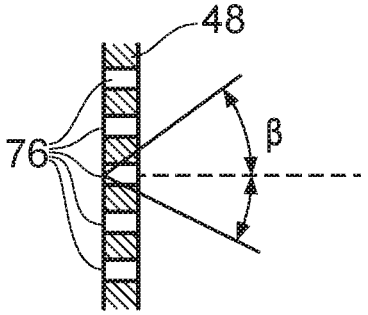
FIG. 8 is a cross-sectional view in the direction of arrows B-B in FIG. 7.

Referring to FIGS. 7 and 8, the diameter of each of the apertures of the third plurality of apertures 76 is greater than or equal to 0.5 mm and less than or equal to 3.5 mm. The distance L2 between adjacent apertures of the third plurality of apertures 76 is greater than or equal one diameter of the apertures and is less than or equal to five times the diameter of the apertures. The apertures of the third plurality of apertures 76 are arranged to direct the coolant circumferentially at angle β of greater than or equal to −10° to less than or equal to +60°, where the positive direction is the direction of flow from the fuel injector. The apertures of the third plurality of apertures may be arranged to direct the coolant at an angle α of greater than or equal to 0° to less than or equal 70° towards the centre of the combustion chamber.

The second plurality of apertures 78 are arranged in a similar manner to the first plurality of apertures 74. The diameter of each of the apertures of the second plurality of apertures 78 are greater than or equal to 0.4 mm and less than or equal to 6 mm. The distance between adjacent apertures of the second plurality of apertures 78 is greater than or equal to half the diameter of the apertures and is less than or equal to four times the diameter of the apertures. The apertures of the second plurality of apertures 78 are arranged to direct the coolant circumferentially at angle ω of greater than or equal to −60° to less than or equal to +60°, where the positive direction is the direction of flow from the fuel injector. The apertures of the second plurality of apertures 78 are arranged to direct the coolant at an angle θ of less than or equal to 10° towards the centre of the combustion chamber or equal to or less than 60° towards the inner annular wall structure. In one particular arrangement, the axes of the second plurality of apertures 78 are arranged parallel to the surface of the inner annular wall structure 40. In another arrangement the axes of the second plurality of apertures 78 are angled circumferentially to form a swirling flow of coolant on the surfaces of the tiles 52A which increases convective cooling of the tiles 52A. The axes of the apertures of the second plurality of apertures 78 are spaced from the surface of the inner annular wall structure 40 by a distance S equal to or greater than half the diameter of the apertures and less than or equal to five times the diameter of the apertures.

The fourth plurality of apertures 80 are arranged in a similar manner to the third plurality of apertures 76. The diameter of each of the apertures of the fourth plurality of apertures 80 is greater than or equal to 0.5 mm and less than or equal to 3.5 mm. The distance L2 between adjacent apertures of the fourth plurality of apertures 80 is greater than or equal to one diameter of the apertures and is less than or equal to five times the diameter of the apertures. The apertures of the fourth plurality of apertures 80 are arranged to direct the coolant circumferentially at angle β of greater than or equal to −10° to less than or equal to +60°, where the positive direction is the direction of flow from the fuel injector. The apertures of the fourth plurality of apertures may be arranged to direct the coolant at an angle α of greater than or equal to 0° to less than or equal 70° towards the centre of the combustion chamber.

The total flow through the third and fourth plurality of apertures 76 and 80 is arranged to ensure that there is sufficient coolant, air, to penetrate into the primary combustion zone to minimise smoke production and to minimise disruption of the fuel and air flow fields produced by the fuel injectors 62. The total flow through the third and fourth plurality of apertures 76 and 80 is equal to or greater than 0.25% of the total combustor air mass flow and equal to or less than 3% of the total combustor air mass flow. The angle β of the third and fourth plurality of apertures 76 and 80 is controlled to ensure that the coolant, air, has maximum interaction with the flows in the primary combustion zone. The angle β may be co-swirling with the flows of fuel and air from the fuel injectors 62 to reduce or minimise the effect on the fuel and air flows from the fuel injectors 62. Alternatively, the angle β may be counter-swirling to the flows of fuel and air from the fuel injectors 62 to increase or maximise mixing in the primary combustion zone to reduce hot spots and smoke production.

The total flow through the first and second plurality of apertures 76 and 80 is arranged to ensure that there is sufficient coolant, air, to form a cooling film of coolant, air, on the surfaces of the outer annular wall structure 42 and the inner annular structure 40 respectively. The total flow through the first and second plurality of apertures 76 and 80 is equal to or greater than 0.5% of the total combustor air mass flow and equal to or less than 5% of the total combustor air mass flow.

As mentioned above the inner annular wall structure 40 comprises a first annular wall 50 secured to the upstream wall 46 and a second annular wall 52 comprising a plurality of rows of circumferentially arranged tiles 52A and 52B. However, it may be equally possible for the first annular wall 50 to comprise a single row of circumferentially spaced tiles in which each tile extends the full length or the majority of the length of the combustion chamber 15. As mentioned above the outer annular wall structure 42 comprises a third annular wall 54 secured to the upstream wall 46 and a fourth annular wall 52 comprising a plurality of rows of circumferentially arranged tiles 56A and 56B. However, it may be equally possible for the fourth annular wall 56 to comprise a single row of circumferentially spaced tiles in which each tile extends the full length or the majority of the length of the combustion chamber 15.

The inner diameter of the inner rail 72 of each heat shield 48 may be arranged at a diameter less than the inner diameter of the upstream ends of the tiles of the row of tiles 52A secured to the first annular wall 50. The outer diameter of the outer rail 70 of each heat shield 48 may be arranged at a diameter greater than the inner diameter of the upstream ends of the tiles of the row of tiles 56A secured to the third annular wall 54.

The apertures of the first plurality of apertures 74 may be circular or may be elongated in a circumferential direction and the apertures of the third plurality of apertures 76 may be circular or may be elongated in a radial direction. Similarly, the apertures of the second plurality of apertures 78 may be circular or may be elongated in a circumferential direction and the apertures of the fourth plurality of apertures 80 may be circular or may be elongated in a radial direction. The apertures of the first plurality of apertures 74 may have a uniform cross-sectional area throughout their length or the apertures of the first plurality of apertures 74 may have a circumferentially divergent exit. The apertures of the second plurality of apertures 78 may have a uniform cross-sectional area throughout their length or the apertures of the second plurality of apertures 78 may have a circumferentially divergent exit.

Alternatively, the inner annular wall structure 40 may simply comprise the first annular wall and the outer annular wall structure 42 may simply comprise the third annular wall 54.

An advantage of the present disclosure is that the curved lips at the radially inner and radially outer ends of the heat shields have been dispensed with. The coolant supplied through the third and fourth plurality of apertures in the heat shields are used to reduce emissions, e.g. smoke, of the combustion chamber. The coolant supplied from the first and second plurality of apertures in the heat shields provide a film of coolant on the outer and inner annular wall structures which may vary circumferentially around the combustion chamber so as to use no more coolant than is required, e.g. more coolant is supplied to circumferential regions operating at a higher temperature and requiring more coolant and less coolant is supplied to circumferential regions operating at a lower temperature and requiring less coolant. The heat shields do not suffer from overheating and oxidation adjacent to the fuel injector apertures when the associated fuel injector seals have suffered overheating and oxidation. When a fuel injector seal has oxidised away the cone angle of the fuel from the associated fuel injector changes and becomes more unstable leading to an increase in mixing of the fuel and air local to the associated heat shield. The radially inner and radially outer ends of the heat shield are most affected by this and experience higher temperature. The present disclosure has removed the curved lips from the radially inner and radially outer ends of the heat shields. The first and second plurality of apertures are located in the outer and inner rails of the heat shields and are positioned nearer to the surfaces of the outer and inner annular wall structures to improve attachment of the film of coolant to the outer and inner annular walls. The heat shields have inner and outer rails and the radially extending flanges which abut the annular walls of the combustion chamber to reduce the leakage of the coolant, air, from the chamber(s) between the upstream wall and the heat shields into the combustion chamber enables more consistent and controlled flow of coolant, air, through the heat shields. The outer and inner rails of each heat shield are located at a smaller distance from the annular walls of the combustion chamber and hence there is a greater surface of the heat shields between the inner and outer rails available to be provided with pedestals and/or effusion cooling apertures. The first, second, third and fourth plurality of apertures are provided in the inner and outer rails of the heat shields and provide internal convective cooling of the inner and outer rails and heat shields and the first, second, third and fourth plurality of apertures in the inner and outer rails are longer than effusion cooling apertures provided in the heat shields to provide improved internal convective cooling in these regions and also to provide better directional control of the coolant flowing through these apertures.

Although the present disclosure has referred to the third plurality of apertures extending through the outer rail of each heat shield and the fourth plurality of apertures extending through the inner rail of each heat shield it may be possible for the third plurality of apertures to simply extend through each heat shield from the chamber between the heat shield and the upstream wall at a diameter less than the diameter of the first plurality of apertures and for the fourth plurality of apertures to simply extend through each heat shield from the chamber between the heat shield and the upstream wall at a diameter greater than the diameter of the second plurality of apertures. Although the present disclosure has referred to the use of a third plurality of apertures and a fourth plurality of apertures extending through each heat shield in some embodiments of the present disclosure the heat shields do not have a third plurality of apertures and a fourth plurality of apertures. In one embodiment, not shown, each heat shield has a flange extending radially outwardly to the third annular wall and has a flange extending radially inwardly to the first annular wall. This arrangement has the same arrangement of the inner and outer rails and the first and second pluralities of apertures and advantages thereof, as described above. In another embodiment, not shown, the each heat shield does not have a flange extending radially outwardly to the third annular wall and does not have a flange extending radially inwardly to the first annular wall.

The combustion chamber may be a gas turbine engine combustion chamber. The gas turbine engine may be an industrial gas turbine engine, an automotive gas turbine engine, a marine gas turbine engine or an aero gas turbine engine. The aero gas turbine engine may be a turbofan gas turbine engine, a turbojet gas turbine engine, a turbopropeller gas turbine engine or a turbo-shaft gas turbine engine.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

The invention claimed is:

1. A combustion chamber comprising an upstream end wall structure, an inner annular wall structure, an outer annular wall structure spaced radially from the inner annular wall structure, the upstream end wall structure comprising an upstream wall and a plurality of heat shields secured to and spaced axially from the upstream wall, the inner annular wall structure being secured to the upstream wall, the outer annular wall structure being secured to the upstream wall, the upstream wall having a plurality of circumferentially spaced fuel injector apertures, the heat shields being arranged circumferentially around the combustion chamber, each heat shield having a radially outer end, a radially inner end, a first circumferential end, a second circumferential end, and a fuel injector aperture aligned with a corresponding one of the fuel injector apertures in the upstream end wall, the radially outer end of each heat shield having an outer rail that is monolithic, extends from the first circumferential end to the second circumferential end, and spaces the heat shield from the upstream end wall, the radially inner end of each heat shield having an inner rail that is monolithic, extends from the first circumferential end to the second circumferential end, and spaces the heat shield from the upstream end wall, a remote end of the outer rail of each heat shield having a surface abutting the upstream wall, a remote end of the inner rail of each heat shield having a surface abutting the upstream wall, the radially outer end of each heat shield having a first plurality of circumferentially spaced apertures extending there-through and through the associated outer rail to direct coolant over the surface of the outer annular wall structure to form a film of coolant, the first plurality of circumferentially spaced apertures of each heat shield extending through the associated outer rail from respective inlets in the surface abutting the upstream wall to respective outlets in a surface of the heat shield facing away from the upstream wall, and the radially inner end of each heat shield having a second plurality of circumferentially spaced apertures extending there-through and through the associated inner rail to direct coolant over the surface of the inner annular wall structure to form a film of coolant, the second plurality of circumferentially spaced apertures of each heat shield extending through the associated inner rail from respective inlets in the surface abutting the upstream wall to respective outlets in the surface of the heat shield facing away from the upstream wall.

2. The combustion chamber as claimed in claim 1 further comprising a third plurality of circumferentially spaced apertures extending through the heat shields to direct coolant towards a centre of the combustion chamber and the first plurality of apertures being positioned radially outwardly of the third plurality of apertures, and a fourth plurality of circumferentially spaced apertures extending through the heat shields to direct coolant towards the centre of the combustion chamber and the second plurality of apertures being positioned radially inwardly of the fourth plurality of apertures.

3. The combustion chamber as claimed in claim 2 wherein the third plurality of circumferentially spaced apertures extends through the associated outer rail to direct coolant towards the centre of the combustion chamber, and the fourth plurality of circumferentially spaced apertures extends through the associated inner rail to direct coolant towards the centre of the combustion chamber.

4. The combustion chamber as claimed in claim 1 wherein a cross-sectional area of the first plurality of apertures varies circumferentially around the combustion chamber, and a cross sectional area of the second plurality of apertures varies circumferentially around the combustion chamber.

5. The combustion chamber as claimed in claim 1 wherein each heat shield has a planar surface facing away from the upstream wall.

6. The combustion chamber as claimed in claim 1 wherein each heat shield has a flange extending radially outwardly towards the outer annular wall structure from the outer rail at the radially outer end of the heat shield and the flange extends parallel to a planar surface of each heat shield facing away from the upstream wall.

7. The combustion chamber as claimed in claim 6 wherein the flange abuts the outer annular wall structure.

8. The combustion chamber as claimed in claim 5 wherein each heat shield has a flange extending radially inwardly towards the inner annular wall structure from the inner rail at the radially inner end of the heat shield, the flange extending parallel to the planar surface facing away from the upstream wall.

9. The combustion chamber as claimed in claim 8 wherein the flange abuts the inner annular wall structure.

10. The combustion chamber as claimed in claim 1 wherein a diameter of each of the apertures of the first plurality of apertures is greater than or equal to 0.4 mm and less than or equal to 6 mm and a distance between adjacent apertures of the first plurality of apertures is greater than or equal to half the diameter of the first plurality of apertures and less than or equal to four times the diameter of the first plurality of apertures, a diameter of each of the apertures of the second plurality of apertures is greater than or equal to 0.4 mm and less than or equal to 6 mm, and a distance between adjacent apertures of the second plurality of apertures is greater than or equal to half the diameter of the second plurality of apertures and less than or equal to four times the diameter of the second plurality of apertures.

11. The combustion chamber as claimed in claim 1 wherein the apertures of the first plurality of apertures are arranged to direct the coolant circumferentially at an angle of greater than or equal to −60° to less than or equal to +60°, where a positive direction is the direction of flow from the fuel injector, and the apertures of the second plurality of apertures are arranged to direct the coolant circumferentially at an angle of greater than or equal to −60° to less than or equal to +60°, where the positive direction is the direction of flow from the fuel injector.

12. The combustion chamber as claimed in claim 1 wherein the apertures of the first plurality of apertures are arranged to direct the coolant at an angle of less than or equal to 10° towards a centre of the combustion chamber or equal to or less than 60° towards the outer annular wall structure, and the apertures of the second plurality of apertures are arranged to direct the coolant at an angle of less than or equal to 10° towards the centre of the combustion chamber or equal to or less than 60° towards the inner annular wall structure.

13. The combustion chamber as claimed in claim 12 wherein axes of the first plurality of apertures are arranged parallel to the surface of the outer annular wall structure, and axes of the second plurality of apertures are arranged parallel to the surface of the inner annular wall structure.

14. The combustion chamber as claimed in claim 1 wherein axes of the apertures of the first plurality of apertures are spaced from the surface of the outer annular wall structure by a distance equal to or greater than half the diameter of the first plurality of apertures and less than or equal to five times the diameter of the first plurality of apertures, and axes of the apertures of the second plurality of apertures are spaced from the surface of the inner annular wall structure by a distance equal to or greater than half the diameter of the second plurality of apertures and less than or equal to five times the diameter of the second plurality of apertures.

15. The combustion chamber as claimed in claim 2 wherein a diameter of each of the apertures of the third plurality of apertures is greater than or equal to 0.5 mm and less than or equal to 3.5 mm and a distance between adjacent apertures of the third plurality of apertures is greater than or equal to one diameter of the third plurality of apertures and less than or equal to five times the diameter of the third plurality of apertures, a diameter of each of the apertures of the fourth plurality of apertures is greater than or equal to 0.5 mm and less than or equal to 3.5 mm, and a distance between adjacent apertures of the fourth plurality of apertures is greater than or equal to one diameter of the fourth plurality of apertures and less than or equal to five times the diameter of the fourth plurality of apertures.

16. The combustion chamber as claimed in claim 2 wherein the apertures of the third plurality of apertures are arranged to direct the coolant circumferentially at an angle of greater than or equal to −10° to less than or equal to +60°, where a positive direction is the direction of flow from the fuel injector, and the apertures of the fourth plurality of apertures are arranged to direct the coolant circumferentially at an angle of greater than or equal to −10° to less than or equal to +60°, where the positive direction is the direction of flow from the fuel injector.

17. The combustion chamber as claimed in claim 2 wherein the apertures of the third plurality of apertures are arranged to direct the coolant at an angle $\alpha$ of greater than or equal to 0° to less than or equal 70° towards the centre of the combustion chamber, and the apertures of the fourth plurality of apertures are arranged to direct the coolant at an angle $\alpha$ of greater than or equal to 0° to less than or equal 70° towards the centre of the combustion chamber.

18. The combustion chamber as claimed in claim 1 wherein the inner annular wall structure comprises a first annular wall secured to the upstream wall and at least one first row of circumferentially arranged tiles, the at least one first row of tiles being secured to and spaced radially outwardly from the first annular wall, the outer annular wall structure comprising a second annular wall secured to the upstream wall and at least one second row of circumferentially arranged tiles, the at least one second row of tiles being secured to and spaced radially inwardly from the second annular wall.

19. The combustion chamber as claimed in claim 18 wherein an inner diameter portion of the inner rail of each heat shield with respect to a center axis of the combustion chamber is arranged inward with respect to an inner diameter portion of the upstream ends of the tiles of the first row of tiles secured to the first annular wall, and an outer diameter portion of the outer rail of each heat shield with respect to the center axis is arranged outward with respect to an inner diameter portion of the upstream ends of the tiles of the second row of tiles secured to the second annular wall.

20. The combustion chamber as claimed in claim 2 wherein the apertures of the first plurality of apertures are circular or elongated in a circumferential direction and the apertures of the third plurality of apertures are circular or elongated in a radial direction, the apertures of the second plurality of apertures are circular or elongated in a circumferential direction, and the apertures of the fourth plurality of apertures are circular or elongated in a radial direction.

* * * * *